United States Patent [19]

Barlow et al.

[11] Patent Number: 4,463,515

[45] Date of Patent: Aug. 7, 1984

[54] SELF-CONTAINED AND SELF-PROPELLED TOY VEHICLE

[75] Inventors: Gordon A. Barlow; John R. Krutsch, both of Glenview; Marvin Smollar, Northbrook; Ronald Liedtke, Addison, all of Ill.

[73] Assignee: Gordon Barlow Design, Skokie, Ill.

[21] Appl. No.: 372,329

[22] Filed: Apr. 27, 1982

[51] Int. Cl.[3] ..... A63H 5/00

[52] U.S. Cl. ..... 446/409

[58] Field of Search ..... 46/206, 209, 202, 201, 46/111, 112

[56] References Cited

U.S. PATENT DOCUMENTS

| | | | |
|---|---|---|---|
| 3,247,614 | 4/1966 | Spengler | 46/192 X |
| 3,826,039 | 7/1974 | Disko et al. | 46/209 X |
| 3,886,682 | 6/1975 | Ieda et al. | 46/202 |

FOREIGN PATENT DOCUMENTS

| | | | |
|---|---|---|---|
| 908337 | 4/1946 | France | 46/201 |
| 2472401 | 7/1981 | France | 46/201 |

*Primary Examiner*—Mickey Yu

*Attorney, Agent, or Firm*—Kinzer, Plyer, Dorn & McEachran

[57] ABSTRACT

A toy motorcycle is mounted on and supported by a front wheel and a driven rear wheel which is heavy enough to act as a flywheel. A pull string mechanism includes a spring biased spring spool having a gear, with a step-up gear train imposed between the spool gear and the rear driven wheel. A centrifugally operated pawl mechanism is driven by the gear train to couple with ratchet teeth formed on the rear wheel in order to drive the rear wheel in one direction and to decouple from the ratchet teeth when the gear train is driven in the opposite direction during string recoil. The rear wheel has a greater moment of inertia than the other components of the pull string drive mechanism to enable the rear wheel to function as a flywheel and thereby store energy to drive the motorcycle. A reed is positioned to be plucked by a rotating cam to produce sound.

11 Claims, 11 Drawing Figures

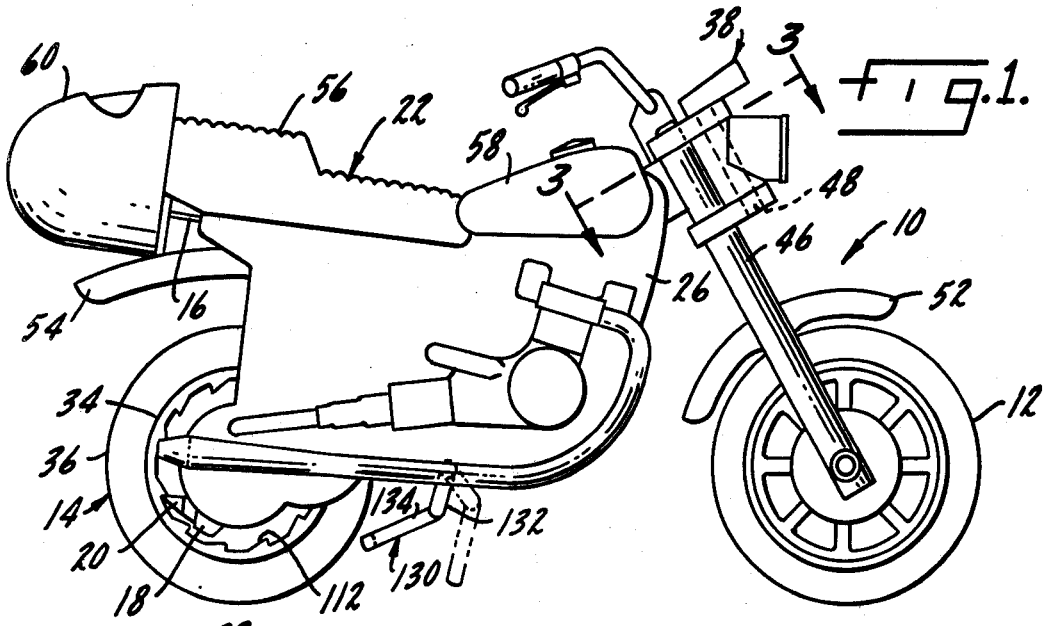
Fig. 1.
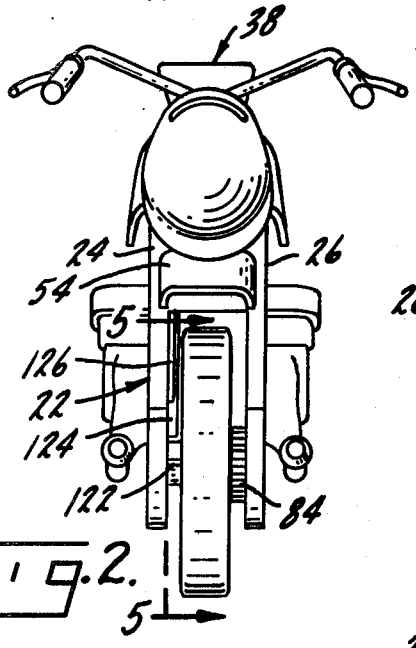
Fig. 2.
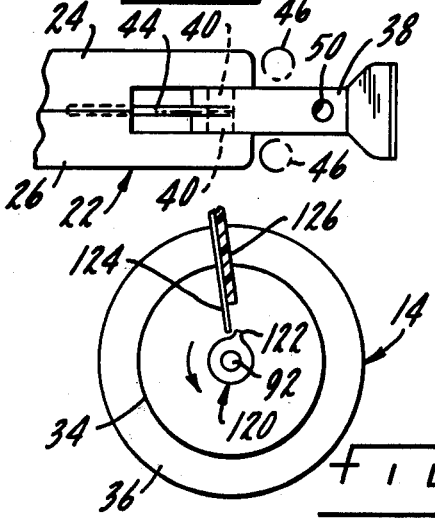
Fig. 3.
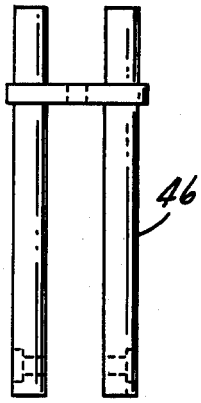
Fig. 4.
Fig. 5.
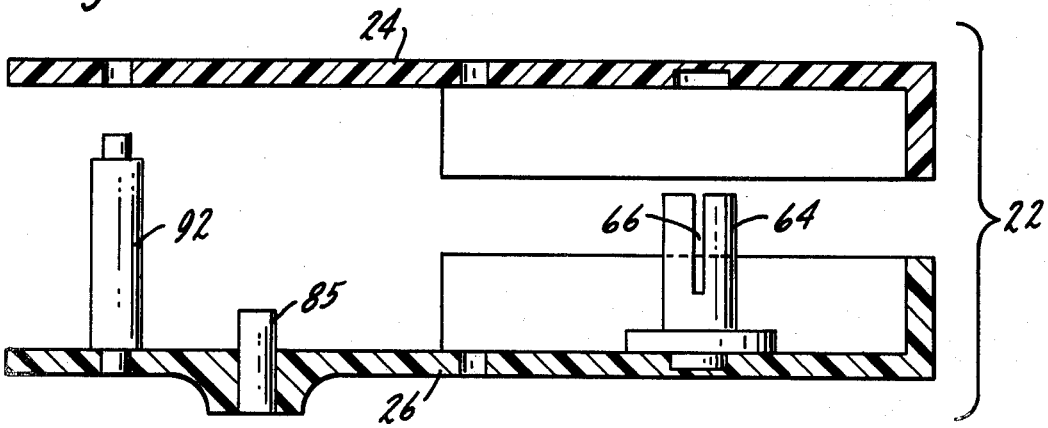
Fig. 6.

Fig. 7.
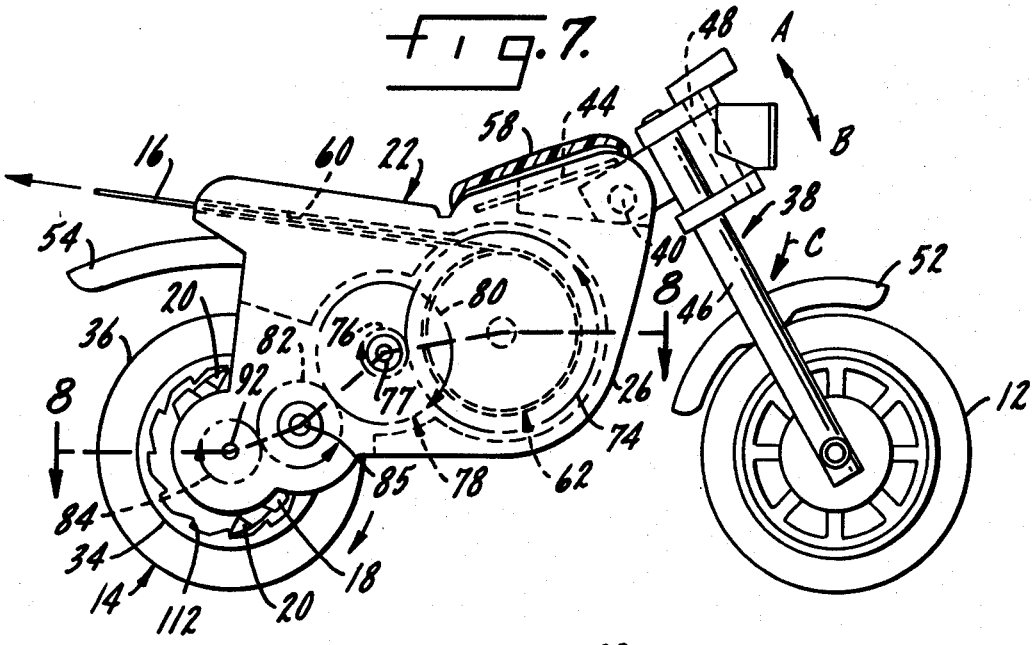
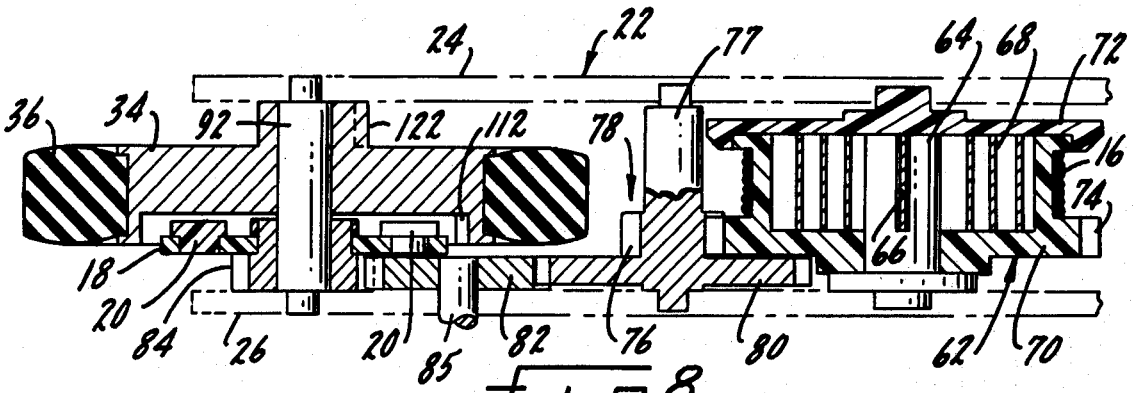
Fig. 8.
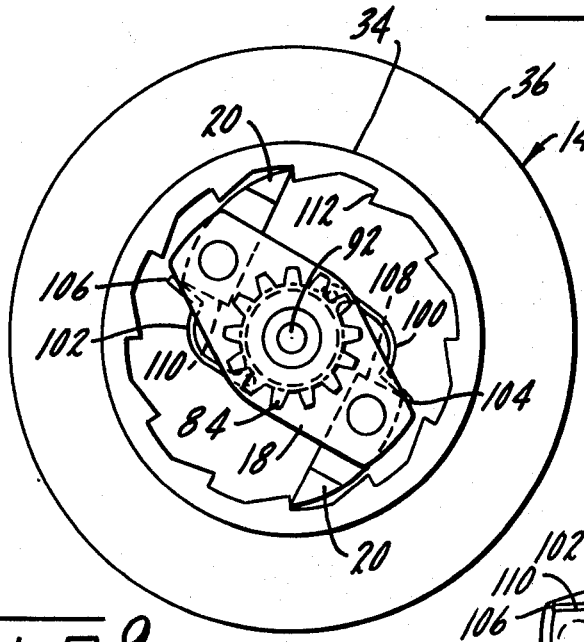
Fig. 9.
Fig. 11.
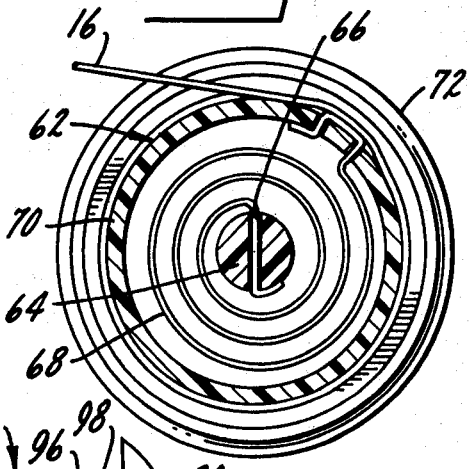
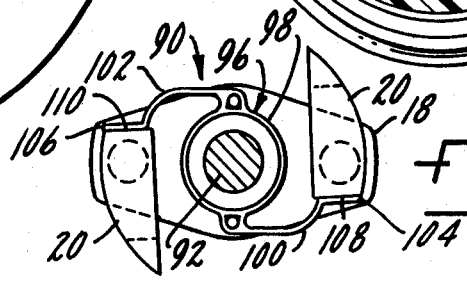
Fig. 10.

SELF-CONTAINED AND SELF-PROPELLED TOY VEHICLE

This invention relates to toy vehicles and more particularly to completely self-contained and self-propelled toy vehicles.

In the following description, it will be convenient to refer to a two-wheeled vehicle, such as a motorcycle, moped, motor scooter, or the like. However, the invention may also be incorporated into other toy vehicles with any number of wheels. For example, a conventional auto has four wheels. Sometimes, autos and even small trucks have three wheels, especially in countries where heavy taxes are applied to four wheeled vehicles. Some trucks may have, say, three to six axles and may have four wheels on some axles. Hence, the following references to a two-wheeled vehicle (by way of example) is to be construed as being a generic disclosure of any suitable vehicles with any suitable number of wheels.

It is important for toys to be simple, foolproof, and easy to operate. It is self-defeating if the toy requires such a high level of manipulative skills that the child has difficulty operating it. It is also more difficult for the child to preceive realism when he is required to use obviously extraneous mechanisms to operate an otherwise realistic toy. If the child has to use many separate parts to wind, separate strips of plastic to pull for imparting energy, or the like, it is likely that at least some of those parts will soon be lost. Or, if a child can push a vehicle backward, for example, and jam gears or break parts, it is more likely that the toy will be damaged.

Accordingly, an object of this invention is to provide new and improved toy vehicles. In this connection, an object is to provide a completely self-contained toy which is free of loose parts that may become lost. Here, an object is to provide a toy which cannot be damaged by pushing it backward.

Another object of the invention is to provide toy vehicles with realism of both sound and appearance. Still another object is to provide self-propelled, two wheeled toys which are able to follow a stable and fairly straight path while running at relatively high speeds.

In keeping with an aspect of the invention, these and other objects are accomplished by a toy vehicle having a frame with a self-steering front wheel and a driven rear, flywheel mounted on and supporting the frame. A recoil pull string mechanism includes a string spool having a gear train imposed between the spool and the driven rear wheel. A centrifugally operated pawl mechanism is coupled to ratchet teeth formed on the rear wheel when the string is pulled to store inertial energy in the rear flywheel. When the pawl operates under the centrifugal forces created by pulling the string, the rear wheel is driven in one direction. As the string recoils the pawl is retracted to decouple from the ratchet teeth so that the pull string may rewind around the spool and also to prevent the gear train from being driven backward if the toy is manually pushed in the wrong direction. This is extremely important because the gear train ratio is selected to give great speed; therefore, if the gear train operates in a backward direction, it gives great power so that even a small child can generate enough power to break the toy.

The invention is illustrated more or less diagrammatically in the following drawings wherein:

FIG. 1 is a side elevational view of a toy motorcycle embodying the novel features of this invention;

FIG. 2 is a rear elevation of the motorcycle showing a preferred location for the noise maker in one embodiment;

FIG. 3 is a partial top plan view (taken along line 3—3 of FIG. 1) of the mounting of the front fork of the motorcycle of FIG. 1;

FIG. 4 is a rear elevational view of the motorcycle fork of FIG. 1 with parts omitted for clarity;

FIG. 5 shows a hub device (taken along line 5—5 of FIG. 2) for driving a motor noise simulating sound maker;

FIG. 6 is an exploded top plan view of the motorcycle frame on an enlarged scale which with some parts omitted for clarity of illustration and others shown in cross-section;

FIG. 7 is a side elevational view of the motorcycle of FIG. 1 with some parts omitted for clarity of illustration and other parts shown in hidden lines with arrows indicating the direction of rotation of the gears as energy is stored in the drive system;

FIG. 8 is an enlarged cross-sectional view taken along lines 8—8 of FIG. 7 with some parts shown in phantom and others broken away for clarity of illustration;

FIG. 9 is an enlarged side elevational view of the rear wheel assembly and ratchet drive mechanism of the motorcycle;

FIG. 10 shows a centrifugal hub assembly for selectively coupling or decoupling the pull string to the flywheel, rear driven wheel; and FIG. 11 is an enlarged cross-sectional view taken through the string spool of this invention.

Briefly, the invention comprises a completely self-contained wheeled toy vehicle 10 running on and supported by substantially aligned front and rear wheels 12, 14. It is self-contained since there are no loose parts to become lost or mutilated. It is self-propelled since all energy required to propel the vehicle is stored within it.

At least one of the wheels (here the rear wheel 14) is made of a material which has a substantial mass for storing inertial energy. Normally, a recoil pull string 16 is wound on a spring loaded spool, completely contained within the vehicle. The recoil string 16 drives the spool that in turn drives the gear train that turns the ratchet causing the rear wheel to rotate. Thus, the string 16 may be pulled repeatedly. The faster the child pulls the cord, the faster the rear wheel will rotate. A centrifugal clutch means 18, 20 is driven by the pull string 16 for coupling the pull string to the rear wheel during a pull of the string and for decoupling the pull string from the rear wheel during a recoil of the pull string. Thus, the driving gear train is normally decoupled from the wheel so that the vehicle cannot be damaged by pushing it backward.

FIG. 1 of the drawings shows a toy in the form of a miniature motorcycle 10. However, it should be understood that the toy could also be in the form of substantially any suitable wheeled motor vehicle.

The toy motorcycle 10 includes a two (forward and aft) housing or body parts, each of which may be die cast metal or molded plastic. One (the aft) body part 22 includes two shells 24, 26 in the shape and form of a vehicle, which shells are fastened together in a face-to-face relationship. For example, if the body shells 24, 26 are made of plastic, they may be cemented or ultrasonically welded together. Mounted on the frame is the rear driven, flywheel 14. The rear wheel is relatively heavy since it functions as both a flywheel and a driven vehicle support wheel. Therefore, it is preferably made of any suitable heavy material, such as brass, zinc, similar metals, or the like. A groove, rim or other suitable tire retaining means 34 is formed in the rear wheel to receive a tire or O-ring 36 which is made of a high friction material.

The toy vehicle has a second or forward body part 38 (FIGS. 1, 3, 7) which is horizontally hinged to the first or aft body part 22. As best seen in FIG. 3, each body shell 24, 26 has an embossment which are in abutment at 40 to form a hinge pin for enabling a limited amount of rotational movement of part 38 relative to part 22. More particularly, FIG. 7 shows the vehicle in its vertical operating position, in which the embossments 40 form a horizontal hinge pin. Therefore, it should be apparent that, when in this position, the forward body part 38 may undertake some limited amount of rotary motion (direction A-B) in the vertical plane.

A leaf spring 44 is anchored at its left-hand end (as seen in FIGS. 3 and 7) to the aft body part 22. The right-hand end of spring 44 presses downwardly on the forward body part 38, thereby urgining the parts 22, 38 to a normally extended position. When the front wheel 12 vibrates during vehicular motion, or if it receives a jolt, as when the vehicle strikes an object, the front fork 46 tends to swing back in direction C about the hinge pin formed by the embossments 40. Then, the leaf spring 44 flexes to act as a shock absorber. Also, the tire on the front wheel is made of a shock absorbing material such as a hollow plastic with a good memory quality.

The front fork 46 supports the front wheel 12 in much the same manner that any bicycle, motorcycle, or moped fork supports a front wheel. The fork has a shaft 48 rigidly associated therewith (FIG. 7) which is rotatably mounted in a journal 50 (FIG. 3) in the forward body member. The shaft 48 is substantially aligned with and in front of the elongation of the fork 46 to mount the fork like a caster. This way, the front wheel 12 wants to hang downwardly in a forward facing position from the shaft 48 and its supporting journal 50. Therefore, if the vehicle tends to turn, the center of gravity rises to cause the front wheel to automatically self-steer in the correct direction for restoring vehicular motion to a straight path. The self-steering is limited to the $\pm 10°$, or thereabout, which is determined by the engagement of the fork arms with forward body part 38.

A fender 52 may be provided for the front wheel and if so, it is attached to the fork 46. A rear fender 54 preferably is an integral part of the aft body part shell pieces 24, 26. Also mounted on the aft body part 22 is a seat 56 (FIG. 1) and a replica of a gasoline tank 58. The sides of shells 24, 26 depict the sides of a motorcycle engine, exhaust pipes, shock absorbers, or the like. Handlebars, a headlight, and instrument panel and any other suitable parts are molded of plastic in part 38. Any suitable colors may be painted or plated on these body parts to resemble the corresponding parts of a conventional moped, motorcycle, or the like.

Rev-up means are provided for imparting energy to a driven wheel on the toy. In greater detail, the pull string 16 terminates in a tab in the form of a replica of a helmet 60 (FIG. 1) which fits against the rear of the seat 56 and rests on the rear fender 54. This helmet is attached to the pull string 16 for enabling a quick pull which imparts rotational motion and therefore stores inertial energy in the rear, driven wheel 14. The pull string 16 extends through a string slot 60 (FIG. 7) formed in the frame pieces 24, 26. As shown in detail in FIGS. 6, 7, 8 and 11, the pull string 16 winds around a string spool 62 which is rotatably mounted on a shaft 64 captured in one or both of the frame pieces 24, 26. The shaft 64 has a spring slot 66 at one end which receives the inner end of a coil spring 68. The other and outer end of the coil spring is bent and captured in openings in the string spool 62, as shown in FIG. 11, thus providing a means for tensioning the spring 68 when the string is pulled and to rotate the string spool 62 to take up the string during recoil.

The string spool 62 may be formed from two plastic members which are fastened together in any suitable manner, such as by cement, ultrasonic welding or the like. One spool member is cup shaped member 70 and the other is a cap 72 which closes the cup. The cup-shaped member 70 has a gear 74 (FIG. 8) formed integrally therewith. This gear meshes with a pinion gear 76 which is part of a gear up or step up gear train 78. Pinion gear 76 is attached to a shaft 77 on which is also mounted a larger gear 80. The shaft 77 is journalled in the frame pieces 24, 26 as is shown in detail in FIG. 8. Gear 80 engages gear 82 of smaller diameter which in turn engages pinion gear 84 formed as part of a pawl mechanism 90. Gear 82 is journalled on stub shaft 85 which is supported on part 26. Gear 80 is prevented from falling off the stub shaft 85 by being captured between the shell 26, the drive arm 18 and the rear wheel 14.

The rear wheel is made of two parts. One part 34 has a generally cup shape with an integral rack of inwardly directed ratchet teeth and the other (not shown) is a cover for the cup and has a general appearance of a wheel cover.

A hub assembly which is enclosed within the cup of the wheel forms a centrifugal clutch means 90, as shown in detail in FIGS. 9 and 10. In greater detail, a drive arm 18 is mounted on the axle 92 which supports the driven rear flywheel 14. The associated gear 84 is driven through the gear train 78 to turn the drive arm 18 with wheel 14. Pivotally mounted on the opposite ends of the drive arm 18 are two pawls 20, 20 which terminate at their outer and free ends in relatively heavy mass members. Therefore, when the drive arm 18 rotates fast enough, the pawls 20 are flung outwardly by centrifugal force. Also mounted on the drive arm is a piece part 96 (FIG. 10) which is preferably an integrally cast plastic part, in one embodiment. The plastic is a material, such as nylon, which has a good memory and spring-like qualities. Piece part 96 includes a central, hub-like member 98 which fits over the hub of gear 84 and rear wheel axle 92 and is suitably keyed to the drive arm 18, to turn with it as it is rotated by the gear 84.

Extending outwardly from opposed sides of the hub member 98 are two leaf springs 100, 102 which are suitably arched to achieve better spring qualities. The outer ends of the leaf springs terminate in flat tabs 104, 106 which normally bear against flat surfaces 108, 110 on the pawls 20, 20. These flat surfaces 104–108, 106–110 normally come together in face to face contact to bias the pawls 20, 20 to a normal and retracted position (FIG. 10) where they do not engage a rack 112 of inwardly directed ratchet teeth integrally formed on the inside circular wall of the cup of rear wheel member 34. It is to be noted that, in the driving mode (FIG. 9), the flat surface 108 (for example) on the pawl 20 is displaced from the flat spring tab 104 on leaf spring 100.

Therefore, on recoil the tension in spring 100 presses against the flat on the pawl to retract and return it to a position (FIG. 10) where the flats 104, 108 are in face to face contact.

The spring retraction of pawls 20, 20, which occurs as the flat surfaces 104, 108 and 106, 110 are pressed together by spring tension, is important since otherwise gravity could cause a pawl to hang down and engage a ratchet tooth in the rack 112 of inwardly directed teeth. If this should happen, a child could drive the gear train 78 backward if he should push the motorcycle backward. Since the gear train 78 could have a ratio of, say 10:1, in order to give great speed, the child's push would be acting through a 1:10 ratio which would provide great power at a low speed, which might be enough to jam the gears and probably to break something (most likely string 16).

When the string 16 is pulled, drive arm 18 rotates at a high speed established by the 10:1 (for example) gear ratio, and centrifugal force flings pawls 20, 20 outwardly (FIG. 9). Each pawl engages an inwardly directed tooth on the rack of teeth 112, thereby driving the rear flywheel. When the string is released, it recoils on spool 62 under the tension of spring 68 while the pawls retract.

When racing the motorcycle 10, the rear driven wheel 14 is brought up to speed by rapidly pulling and releasing pull string 16 any suitable number of times while the wheel 14 continues to rotate at high speed between pulls, due to its inertia. The direction of rotation of the gears of the gear train 78 in response to a pull of the pull string 16 is indicated by arrows in FIG. 7. The rearward recoil and retraction of the pull string 16 rotates the string spool 62 in a counterclockwise direction as viewed in FIG. 8. Rotation of the string spool 62 is imparted through the spool gear 74 to the step up gear train 78. The gear train drives the pawls 20, 20, under centrifugal force, into engagement with the ratchet teeth of rack 112 on the rear driven wheel 14.

When the pull string 16 has been fully extended, it is released. The unwinding of the coil spring 68 rotates the string spool 62 in a clockwise direction as viewed in FIGS. 7 and 11 to rewind the string around the cup shaped member 70 and to return the helmet 60 to its normal rest position against the back of the seat 56. Upon the rewinding of the pull string, the gear train 78 is driven in the direction opposite to which it is driven by operation of the pull string. However, because the pawls 20, 20 are retracted (FIG. 10), the continued forward rotation of the driven wheel 14 is not impaired. The pull string 16 may be pulled and released repeatedly until the rear wheel 14 reaches its desired rotational speed.

When the rear wheel has reached its desired rotational speed, the motorcycle is placed on a running surface and it speeds away. When the motorcycle is racing along, the rear wheel, because of its weight and rotation, acts as a gyroscope to help maintain the dynamic balance of the motorcycle and to keep it from tipping. The fact that the front wheel hangs from shaft 48 and journal 50 and the front fork is caster mounted, causes the front wheel to automatically turn in a direction that helps to maintain a straight journey and an upright position for the motorcycle. Stability is also increased by using the rear wheel itself as the flywheel because its rotation, which is in the direction of movement of the motorcycle, aids stability.

The toy quality is enhanced if there is an associated noise which occurs when the rear wheel is rotating and if that noise is a faithful simulation of a motorcycle or moped motor sound. FIGS. 2 and 5 show how this noise is produced. Noise is present in any event because of the moving parts of the motorcycle but the noise making mechanism shown enhances the realism.

A cam 122 is mounted on the side of rear wheel 14 hub 34, which is opposite the side having the rack 112 of ratchet teeth and pawl mechanism. The cam 122 makes one complete revolution during every revolution of the rear wheel 14. Positioned near the wheel and in a location to be plucked by cam member 122 is a reed 124 which is anchored in a spaced parallel, face to face relationship with a protrusion 126 which is integrally formed on the body shell 24.

Each time that the reed 124 is plucked and released by the cam member 122, the reed is first deflected away from and then released to fly back toward the body shell protrusion 126. On the fly back, the reed 124 loudly slaps the body shell protrusion 126. The reed rebounds from the slapping position so that it does not rest on the protrusion 126 and deaden the sound.

The interior of the hollow housing formed by shells 24, 26 acts as an acoustical resonator or amplifier to enhance the sound. The closer the protrusion 126 is to a resonant point, the louder the sound becomes. A little experimentation will make it apparent where the reed 124 and protrusion 126 should be positioned for any given body shell in order to maximize the sound.

Also, the material used to make the reed 124 is important. Some materials give a metallic twang while others give a dull thud, neither of which is particularly realistic. It has been found that a remarkably realistic motorcycle sound occurs when the reed 124 is made of vulcanized fiber, for example, which has an internal vibration damping quality. This is a readily available material (popularly called "fish paper") which is widely used as an insulator by the electrical industry. An advantage of this vibration damping material is that it gives a loud and realistic sound without extracting very much energy from the fly wheel.

Rotatably mounted on the bottom of the aft body part 22 (FIG. 1) is an L-shaped kick stand member 130 with an upright arm 132 which is set at an off vertical angle. The angle is such that, when the lower arm 134 is rotated in one direction, it is raised to an elevated position shown in solid lines. When it is rotated in an opposite direction, shown by phantom lines, it is in a vehicle supporting position.

Those who are skilled in the art will readily perceive how to modify the invention. Therefore, the appended claims are to be construed to cover all equivalent structures which fall within the true scope and spirit of the invention.

We claim:

1. A simplified compact toy motorcycle including: a frame, a front wheel and a driven rear wheel mounted on the frame, a rev-up mechanism for imparting energy to the rear driven wheel including a string spool having a gear, a pull string windable around the spool, means for retracting and rewinding the pull string around the spool, a step up gear train interposed between the spool gear and the driven rear wheel, the driven rear wheel having a greater moment of inertia than the other components of the rev-up mechanism to allow the rear wheel to function as a flywheel to store energy imparted by the rev-up mechanism, a cavity formed in one side of the rear wheel, internal ratchet teeth formed around the cavity, and a pawl mechanism located in the cavity and driven by the step up gear train, the pawl mechanism having pawls which engage the ratchet teeth to drive the rear wheel when the gear train is driven in one direction and to disengage from the ratchet teeth when the gear train is driven in the opposite direction.

2. The toy motorcycle of claim 1 in which the pawl mechanism includes a pair of pawls, the pawls being pivotally attached to opposite ends of a plate which is affixed to rotate with a gear of the step up gear train.

3. The toy motorcycle of claim 2 including spring means engaging the pawls to bias them away from engagement with the ratchet teeth, the spring means being formed separately from the pawls and being engageable therewith.

4. The motorcycle of claim 3 in which at least said spring means is an integral casting with at least one leaf spring extending outwardly to bear against a flat surface on each pawl, each pawl being pivotally mounted on an end of said rotating plate, and each leaf spring and pawl rotating with and being suspended over said plate.

5. The motorcycle of claim 1 in which at least one wheel has a hub assembly means having a cam which turns responsive to the energy stored by the pull of the string, reed means repeatedly plucked by the cam as the wheel rotates, and housing means for the motorcycle, said housing means having a protrusion which is slapped by the plucked reed.

6. The motorcycle of claim 5 in which the housing means acoustically amplifies the sound of the reed slapping against the protrusion.

7. The motorcycle of claim 5 in which the reed is made of a material having internal vibration damping qualities.

8. The motorcycle of claim 5 in which the reed and the protrusion are mutually positioned to give a substantially loud sound with little loss of internal energy from the wheel.

9. The toy motorcycle of claim 1 in which the front wheel is located at the lower end of a fork, the fork is pivotally mounted on a frame extension for rotation about an axis rearwardly inclined from the vertical, and the pivotal mount is positioned generally parallel to and located in front of the fork to provide self steering for the front wheel.

10. The toy motorcycle of claim 9 in which the frame extension is pivotally mounted on the frame for rotation about a generally horizontal axis, and spring means are provided to engage the frame extension to urge the front wheel forward so as to function as a shock absorber for the front wheel.

11. The toy of claim 4 or 5 wherein said pull string terminates in a helmet simulation mounted on the rear of said vehicle.

* * * * *